US006109912A

United States Patent [19]

Robinson et al.

[11] Patent Number: 6,109,912

[45] **Date of Patent: *Aug. 29, 2000**

[54] FUEL VAPORIZER

[75] Inventors: Edgar C. Robinson, Vancouver; Leonard Fleming, Delta, both of Canada

[73] Assignee: International Thermal Investments Ltd., Richmond, Canada

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/475,052

[22] Filed: Jun. 7, 1995

Related U.S. Application Data

[63] Continuation-in-part of application No. 08/163,905, Dec. 6, 1993.

[51] Int. Cl.[7] ..... F23D 11/44

[52] U.S. Cl. ..... 431/247; 431/333; 431/338; 126/95

[58] Field of Search ..... 431/247, 248, 431/331, 333, 11, 218, 222, 223, 227, 338, 229, 100, 103, 104, 105, 106, 107; 126/95, 44

[56] References Cited

U.S. PATENT DOCUMENTS

| | | | |
|---|---|---|---|
| Re. 28,679 | 1/1976 | Robinson | 431/9 |
| 360,558 | 4/1887 | Bussey | 431/218 |
| 747,434 | 12/1903 | Jaeger | 431/247 |
| 1,048,310 | 12/1912 | Hemphill et al. | 431/228 |
| 1,188,083 | 6/1916 | Koerting | 431/248 |
| 1,577,773 | 3/1926 | Stroud | 431/228 |
| 1,594,202 | 7/1926 | Jalbert . | |
| 1,618,392 | 2/1927 | Stroud | 431/227 |
| 1,652,803 | 12/1927 | Stroud . | |
| 1,799,725 | 4/1931 | Brown . | |
| 2,477,191 | 7/1949 | Maultsby . | |
| 3,577,730 | 5/1971 | Oliphant . | |
| 4,807,850 | 2/1989 | Robinson . | |
| 5,033,956 | 7/1991 | Nystrom . | |
| 5,102,328 | 4/1992 | Robinson . | |
| 5,759,024 | 6/1998 | Robinson | 431/247 |

FOREIGN PATENT DOCUMENTS

| | | |
|---|---|---|
| 1046262 | 12/1953 | France . |

*Primary Examiner*—Carl D. Price
*Attorney, Agent, or Firm*—John Russell Uren

[57] ABSTRACT

A heater with a fuel vaporizer. The vaporizer has an uptube for carrying fuel and is centrally located within the burner. A cap is located over the uptube. A tubular casing forms an annulus about the uptube and communicates with the cap. Vaporizer fuel is carried upwardly in the uptube and downwardly in the annulus. A zero pressure regulator provides fuel to the burner.

6 Claims, 11 Drawing Sheets

FUEL VAPORIZER

CROSS-REFERENCE TO RELATED APPLICATION

This application is a continuation-in-part of U.S. application Ser. No. 08/163,905 filed Dec. 6, 1993 entitled IMPROVED FUEL VAPORIZER.

INTRODUCTION

This invention relates to a fuel regulator and, fuel vaporizer and, more particularly, to a temperature compensated fuel regulator and improved vaporizer for regulating the amount of fuel which may be passed to a burner and for vaporizing the fuel in an improved manner when it arrives.

BACKGROUND OF THE INVENTION

It is convenient for flexibility purposes to utilise a fuel regulator which is adapted to regulate any of a plurality of fuels, for example gasoline, fuel oil, diesel fuel, kerosene and the like which each have a different viscosity. In the past, orifices of different sizes have been used to pass each of the fuels in order to compensate therefore.

However, the viscosity of the fuel will also depend on the temperature of the fuel. As the temperature increases, the viscosity decreases with the result that the fuel will flow much more quickly and vice versa. The size of the orifice through which the particular fuel will pass, therefor, is an average value found by taking the viscosity of the particular fuel at a temperature which will ordinarily be most widely used when the burner is being used. If, however, the temperature changes such that the flow of the fuel also changes in a magnitude such that the burning of the fuel is affected, the orifice size would have to be changed to allow the proper quantity of fuel to pass under the particular temperature in order to realize the desired heating.

This is so since if the orifice size was not changed and if the temperature increased, it is possible for enough fuel to pass through the orifice such that the burner is flooded and shut down or which can create a fire hazard. If less fuel passes than necessary, the heat produced by the burner could be insufficient.

In another aspect of the invention, fuel vaporizers are known and generally utilize an uptube which allows the fuel to increase its temperature prior to vaporization. A downtube, commonly known as an "R-tube", is used to distribute the vaporized fuel on one side of the uptube.

The downtube on existing vaporizers, however, does not disperse the vapor evenly in the burner. The vaporized fuel emanating from the downtube creates uneven fuel flow with more vaporized fuel on one side of the uptube than on the other size. This results in uneven burning with flames higher on one side of the burner than the other. Therefore, the combustion is relatively inefficient.

SUMMARY OF THE INVENTION

According to one aspect of the invention, there is provided a heater comprising an outer casing and a burner positioned within said outer casing, said burner including a fuel vaporizer, said vaporizer having an uptube for carrying and vaporizing fuel extending substantially vertically and being centrally located within said burner, said burner uptube being open at the most vertical end, a cap centrally located over the open end of said burner uptube, a tubular casing having a longitudinal axis and an inside, said tubular casing extending downwardly from said cap and an annulus defined by said outside of said burner uptube and said inside of said tubular casing, said annulus communicating with said most vertical end of said burner uptube and being operable to carry fuel vapour received from said burner uptube downwardly and to disperse said fuel vapour around the circumference of said burner uptube.

According to a further aspect of the invention there is provided a heater for burning fuel comprising an outer casing, a burner positioned within said outer casing and a fuel regulator to supply fuel to said burner, said burner including a fuel vaporizer, said vaporizer comprising an uptube extending generally vertically upwardly in said heater and a downtube extending generally vertically downwardly in said heater, said uptube communicating with said downtube through a cap located above said uptube and said downtube, said fuel being vaporized in said uptube, said vaporized fuel passing to said downtube and communicating therewith through said cap, said fuel regulator being a zero pressure regulator.

According to yet a further aspect of the invention, there is provided a burner comprising a fuel vaporizer, said vaporizer having an uptube for carrying and vaporizing fuel extending substantially vertically and being centrally located within said burner, said uptube being open at the most vertical end, a cap centrally located over said open end of said burner uptube, a tubular casing having a longitudinal axis and an inside, said tubular casing extending downwardly from said cap and an annulus defined by said outside of said burner uptube and said inside of said tubular casing, said annulus communicating with said most vertical end of said burner uptube, said annulus being operable to carry fuel vapour received from said uptube downwardly and to disperse said fuel vapour around the circumference of said burner uptube.

According to still yet a further aspect of the invention, there is provided a burner comprising a fuel vaporizer and a fuel regulator, said vaporizer comprising an uptube extending generally vertically in said heater and a downtube extending generally vertically in said heater, said uptube communicating with said downtube through a cap located above said uptube and said downtube, said fuel being vaporized in said uptube and said vaporized fuel passing to said downtube and communicating therewith through said cap, said fuel regulator being a zero pressure regulator.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
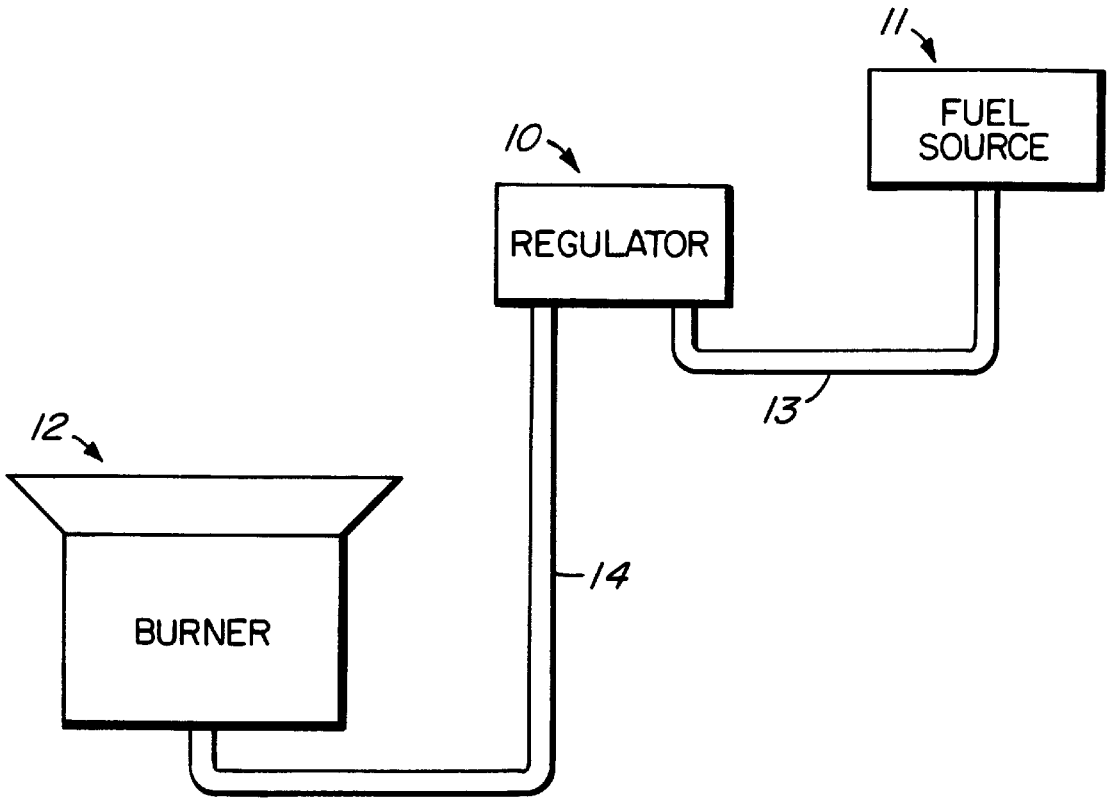
FIG. 1 is a diagrammatic block diagram of the fuel system comprising a burner being fueled by a temperature compensated fuel regulator which receives its fuel from a fuel source, all being in accordance with the invention.

Referring now to the drawings a temperature compensated fuel regulator is generally illustrated at 10 in FIG. 1. It is operably connected by a fuel line to a fuel source generally illustrated at 11 and to a burner generally illustrated at 12 downstream from the regulator 10.

Conveniently, the fuel source 11 will have the ability to utilise three or more fuels as desired by the operator, for example gasoline, diesel, jet fuel, kerosene and the like, although this is particularly attractive to the military for flexibility and is not a requirement for usual use outside the military. Likewise, the burner 12 desirably has the ability to burn any of the fuels although, again, this is not mandatory under non-military conditions.

Figure 2A:
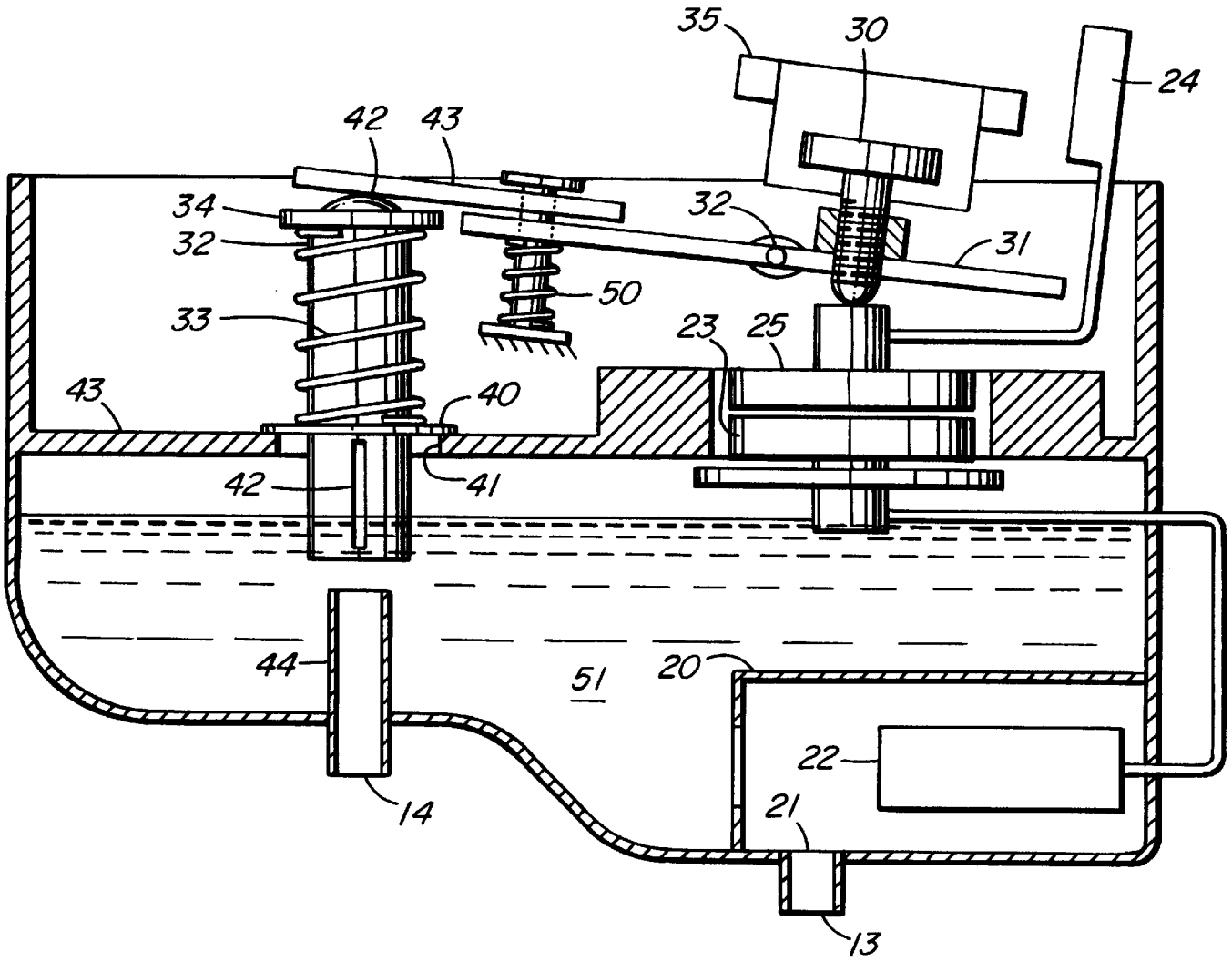
FIG. 2A is a diagrammatic partially cross-sectional side view of the fuel regulator according to the invention.

The regulator 10 is illustrated in greater detail in FIG. 2A. It comprises an inlet line 13 and an outlet line 14. A compartment 20 is formed immediately inside the inlet opening 21 of the regulator 10 and a first liquid filled temperature sensor 22 is located inside the first compartment 20 to sense the temperature of the oil within the compartment 20 and is connected to a diaphragm 25.

A second diaphragm 23 is provided. Diaphragm 23 is connected to a second temperature sensor 24 which conveniently may monitor either the temperature of the burner 12 in which event it is intended to shut down the fuel supply to the burner 12 when the burner 12 overheats or ambient conditions in which event it shuts off the burner 12 when the ambient temperature reaches its desired value. Diaphragm 23 may also be connected to a temperature sensor 22 which monitors the temperature of the incoming fuel. A manual adjustment screw 30 is provided, the screw 30 acting to rotate lever 31 about an axis 34 as will be described in greater detail hereafter.

A metering stem 32 is mounted within a spring 33 and a collar 34 extends around and is mounted to the fuel cylinder 32. A collar 40 extends across the opening 41. The spring 33 provides an outwards bias on the fuel cylinder 32 which tends to keep the contact portion 42 of the metering stem 32 in contact with the arm 42.

Figure 2B:
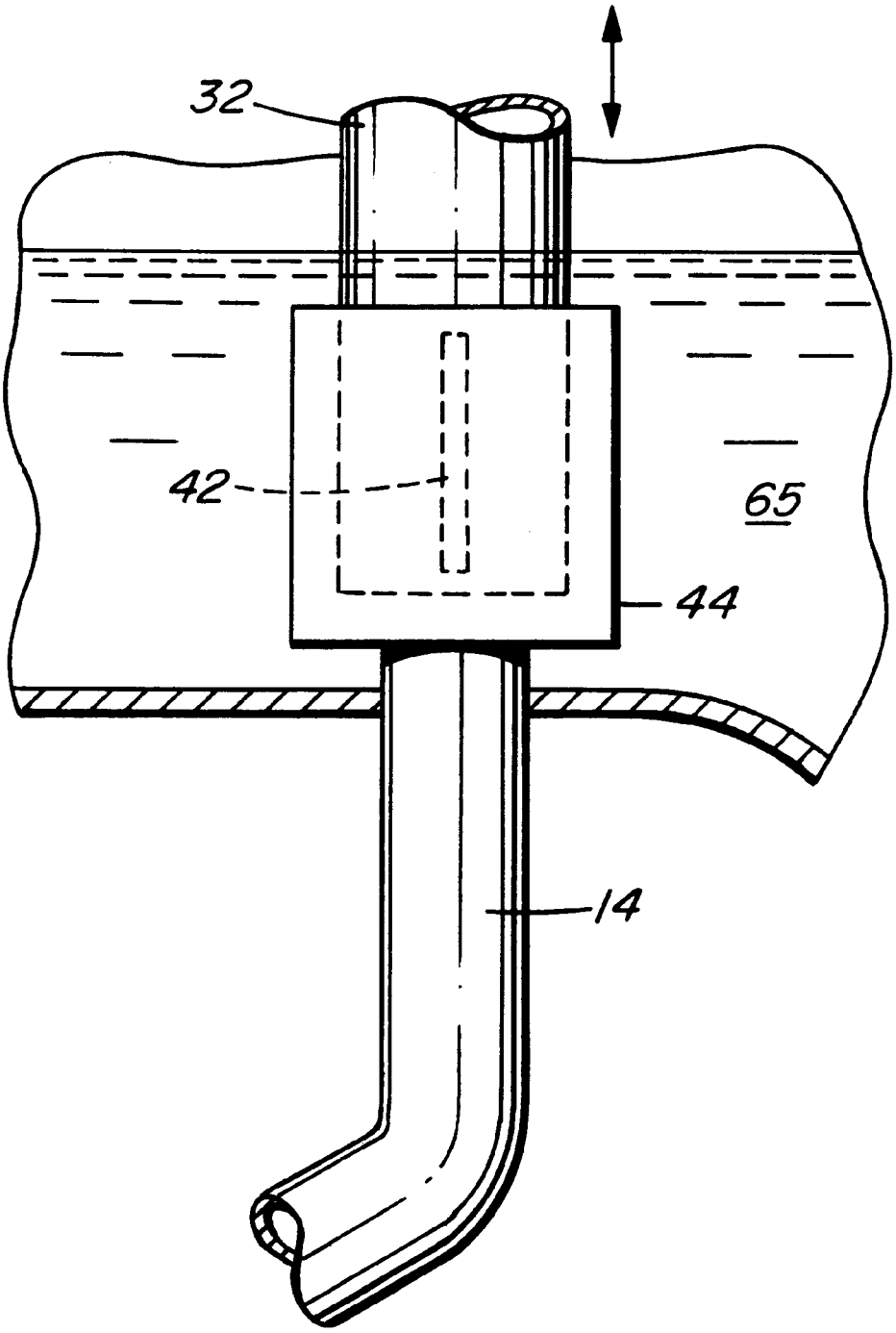
FIG. 2B is a diagrammatic enlarged view of the orifice in the fuel regulator.

The metering stem 32 also includes an orifice 42. The orifice is integral with the metering stem 32 and moves with the fuel cylinder 32 (FIG. 2B) as it moves relative to the housing 43 of the regulator 10. An outlet pipe 44 extends from the fuel cylinder 32 to the outlet line 44.

A compression spring 50 extends between the lever 31 and the ground in order to bias the lever 31 and the manual adjustment screw 30 against the diaphragm 23 about axis 34.

Figure 3:
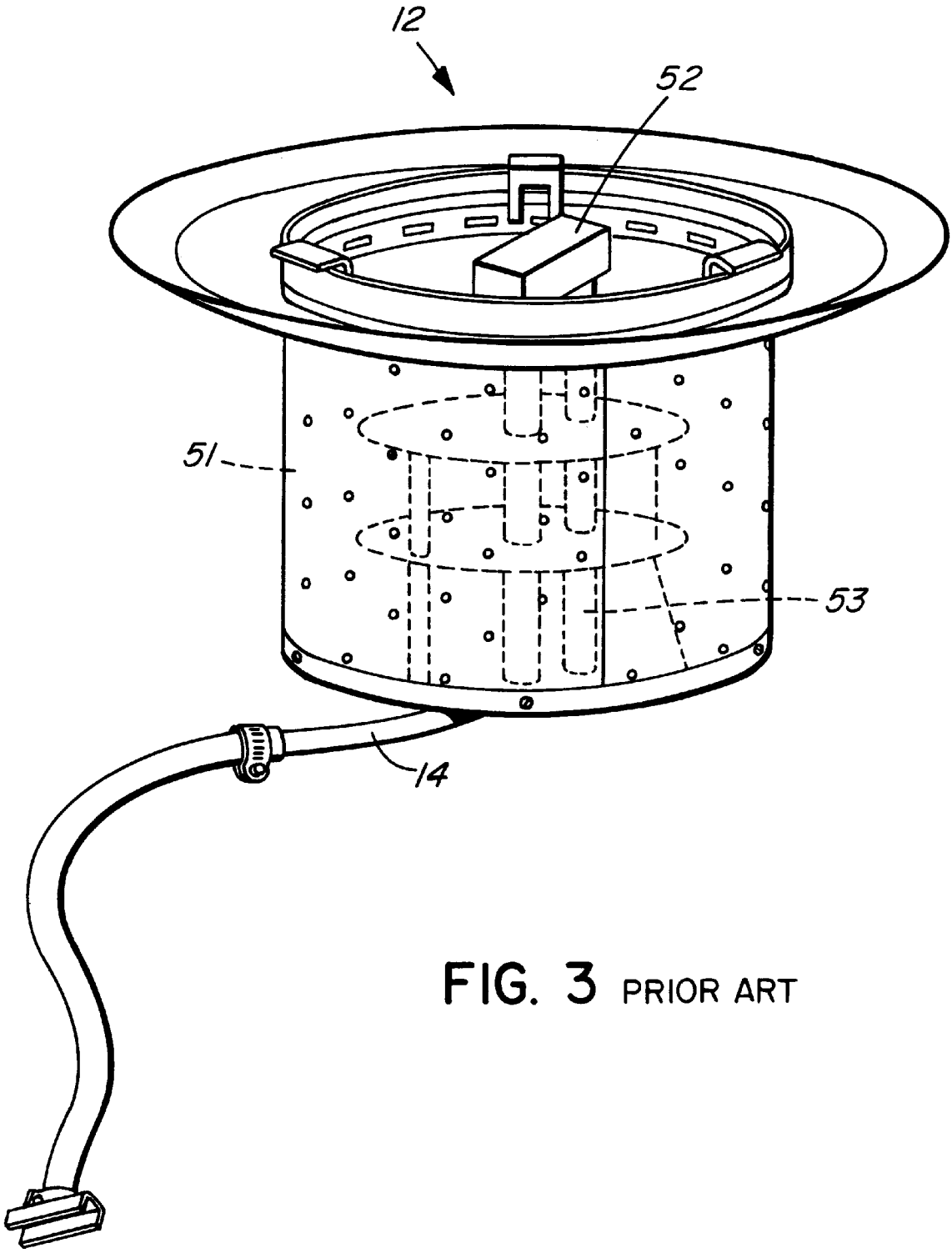
FIG. 3 PRIOR ART
FIG. 3 is an isometric view of a burner as is known in the prior art.

The burner 12 is illustrated in greater detail in FIG. 3 and is the type used in the prior art. It comprises the fuel inlet tube 14 which extends from the regulator 10 to the burner uptube 51. A cap 52 is provided and a burner downtube 53 extends downwardly from the cap 52. As the fuel is vaporized in uptube 51, it passes into the cap 52 and thence to the downtube 53. The vapor is dispersed about the bottom of the burner 12 but principally on one side of the burner 12 and burner uptube 51.

Figure 4A:
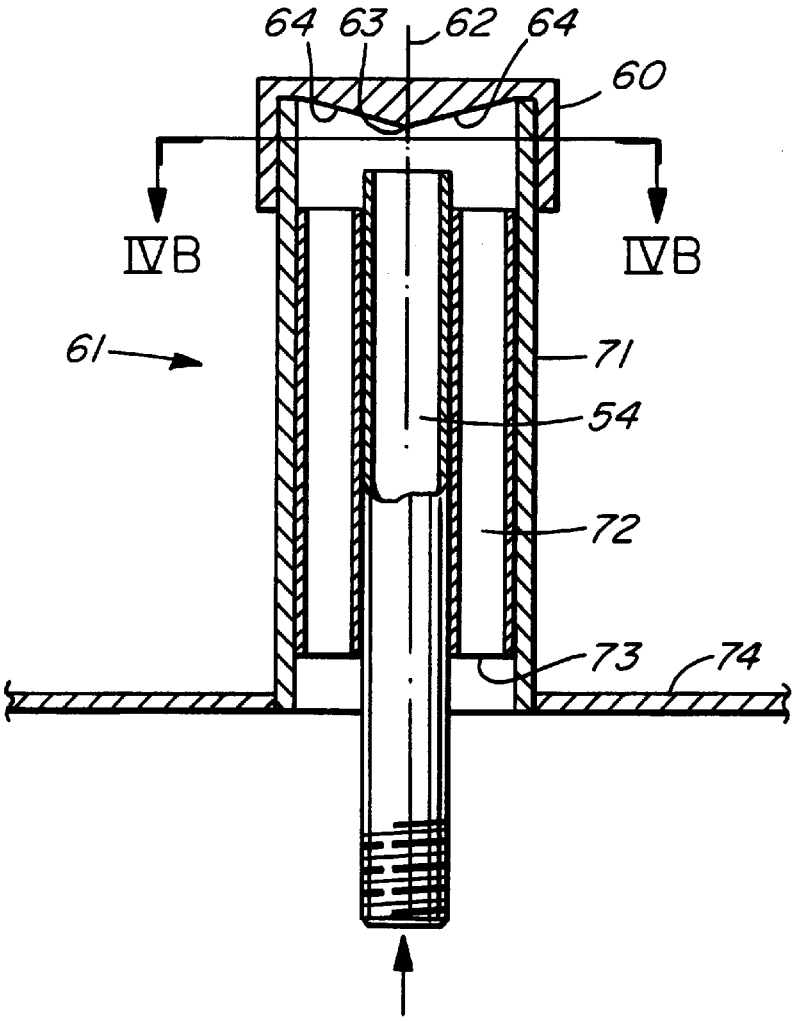
FIG. 4A is a diagrammatic and enlarged view of the vaporizer according to a further aspect of the invention.

Reference is now made to FIG. 4A where a vaporizer according to the invention is generally illustrated at 61. It comprises a burner uptube 54 and a burner cap 60 centrally located over the axis 62 of the burner tube 54. The burner cap 60 has an apex 63 with the surfaces 64 extending upwardly and outwardly from the apex in order to smoothly disperse the vapor from burner tube 54 about its circumference. An annulus 70 is provided between the burner tube 54 and the casing 71 of the vaporizer 61. Conveniently, a plurality of burner downtubes 72 (FIG. 4B) fill the annulus 70 and extend downwardly from the burner cap 60 to an end 73 which then disperses the vapor received from the burner uptube 54 and distributed to the burner downtubes 72 by the burner cap 60. A perforated or solid superheater 74 may be mounted about the burner casing 71 to enhance combustion efficiency by mixing the air with the fuel vapor.

OPERATION

In operation, it will be assumed that the fuel source 11 holds diesel fuel and that this diesel fuel is being passed to the regulator 10.

As the fuel leaves the inlet opening 21 from the fuel line 13, it enters compartment where the temperature of the incoming fuel is sensed by sensor 22. The sensor 22 will emit fluid or take fluid from the diaphragm 23 and the diaphragm 23 and will expand or contract depending on the temperature of the fuel in the compartment 20. If, for example, the temperature of is very low, the sensor will take fluid from the diaphragm 23 and the contraction of the diaphragm 23 will provide a downwardly directed force on the manual adjustment screw 30 which is threadedly mounted in lever 31 and the lever 31 will rotate clockwise about axis 34 under the influence of compression spring 33.

The clockwise rotation of the lever 31 will move the metering stem 32 upwardly in the fuel 51 and orifice 42 likewise moves with metering stem 32 relative to outlet pipe 44 (FIG. 2B) to expose more of the orifice 42 to the fuel 51 such that more fuel will pass through the orifice 42. The fuel will move downwardly within the metering stem 32, into the outlet pipe 44 and from the outlet pipe 44 into the outlet line 14 and thence to the burner 12.

As the fuel warms, the sensor 22 will signal the diaphragm 23 appropriately in order to reduce the size of the orifice 42 exposed to the fuel 51 and, thereby, to allow the appropriate reduced amount of fuel to pass through the orifice 42 to the burner 12.

A first manual adjustment screw 30 allows the system to be calibrated for certain temperature conditions. That is, the screw 30 will be adjusted such that the proper amount of fuel will be passed to the burner 12 under certain known temperatures. After the manual adjustment, the screw 30 will remain in such adjusted position relative to lever 31 and the diaphragm 23 will provide the only movement to lever 31 and metering stem 32. A second manual adjustment screw 35 may also be conveniently provided and will allow the orifice 42 to be of a size for a particular fuel.

A second temperature sensor 24 may also be provided as described. The sensor 24 is connected to the heater or burner 12 and is used to prevent overfueling. For example, in the event the temperature of the heater 12 increases beyond a predetermined set level, the temperature sensor 24 can act to reduce the fuel flow through the orifice 42 in order to remove the unsafe condition. Alternatively, it may monitor ambient conditions such that the burner 12 is shutdown when a desired temperature is reached. Of course, a temperature sensor could be used for both purposes simultaneously in addition to sensor 22.

While it is convenient to utilize a single orifice for multiple fuels, it may be the case that multiple orifices will be required so that different fuels can be used from the fuel source 11. It may well be the case that different fuels are desired to be used from the fuel source 11. In this event, it would be possible to utilize a plurality of orifices 42 in the metering stem 32 and to expose only that orifice 42 relating to the particular fuel to the fuel 51 in the regulator 10. The remaining orifices would be unused. The particular fuel being used would dictate the orifice and such orifice could be selected manually from a rotatable control for example.

As the fuel moves into the burner uptube 54 (FIG. 4A), it will be heated by the heat of the burner 12 and the fuel will vaporize in the burner uptube 54. As the fuel vaporizes, it will leave the burner uptube 54 at its open end and be smoothly dispersed about the apex 63 of the burner cap 60 to the downtubes 72 in the annulus 70. The vaporized fuel will be evenly dispersed from the downtubes 72 about the circumference of the burner uptube 54 and, accordingly, the flame in the burner 12 will be more even throughout the burner 12.

Figure 4B:
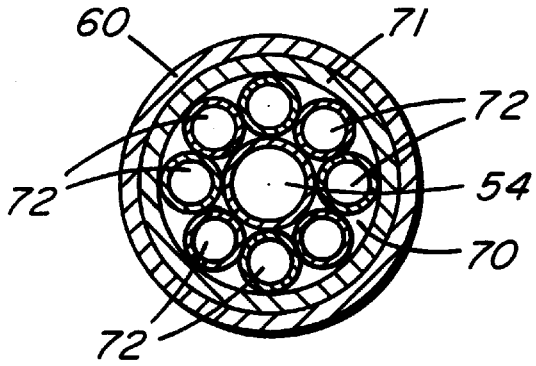
FIG. 4B is a diagrammatic view taken along IVB—IVB of FIG. 4A.

While it is contemplated that downtubes 72 will fill the annulus 70 is illustrated in FIG. 4B, it is also contemplated that an open annulus would be of benefit, the objective being to evenly disperse the fuel vapor about the burner uptube 54 in order to provide more uniform combustion in the burner 12.

Figure 4C:
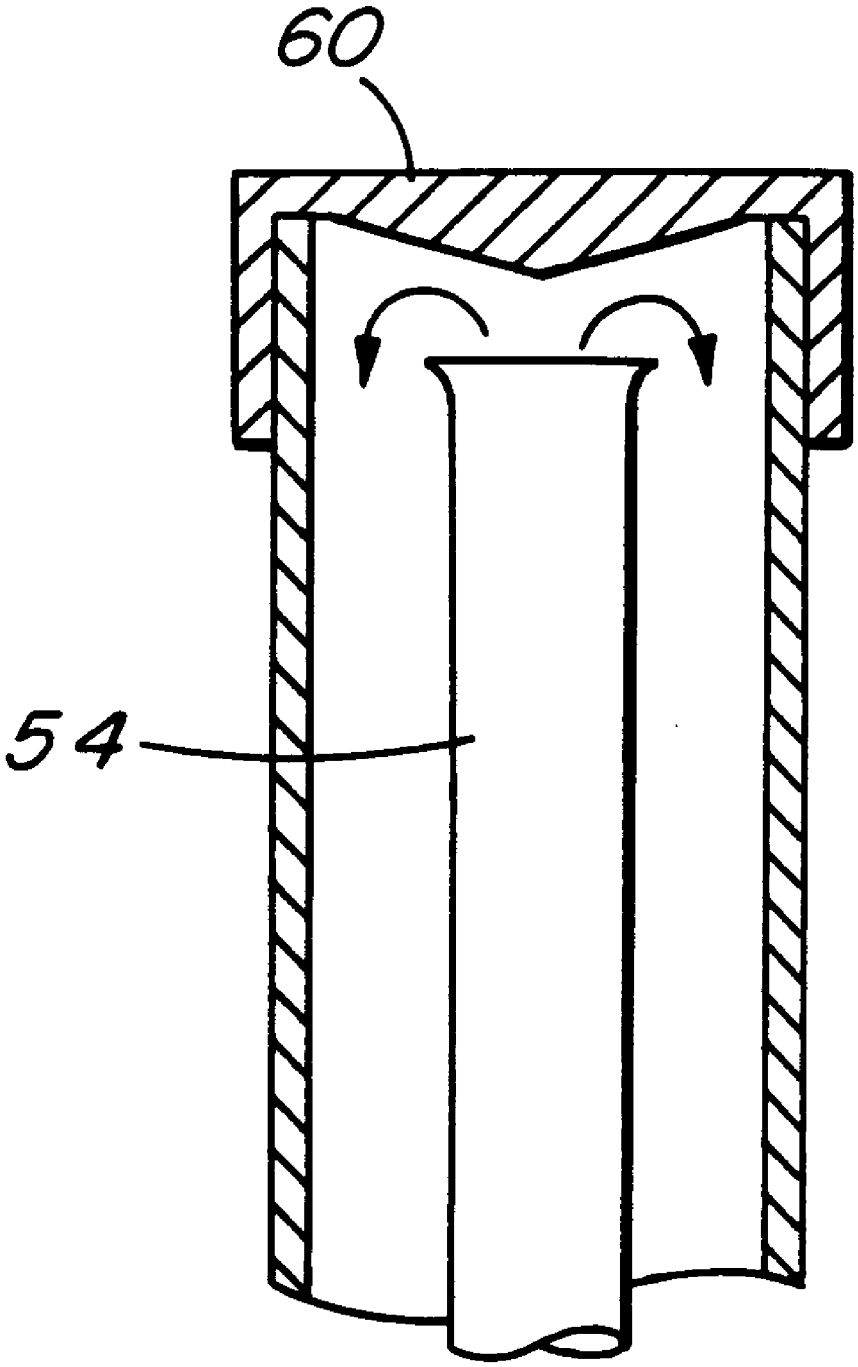
FIG. 4C, appearing with FIG. 2B is an enlarged partial side view of the vaporizer of FIG. 4A in a different embodiment.
Figure 5:
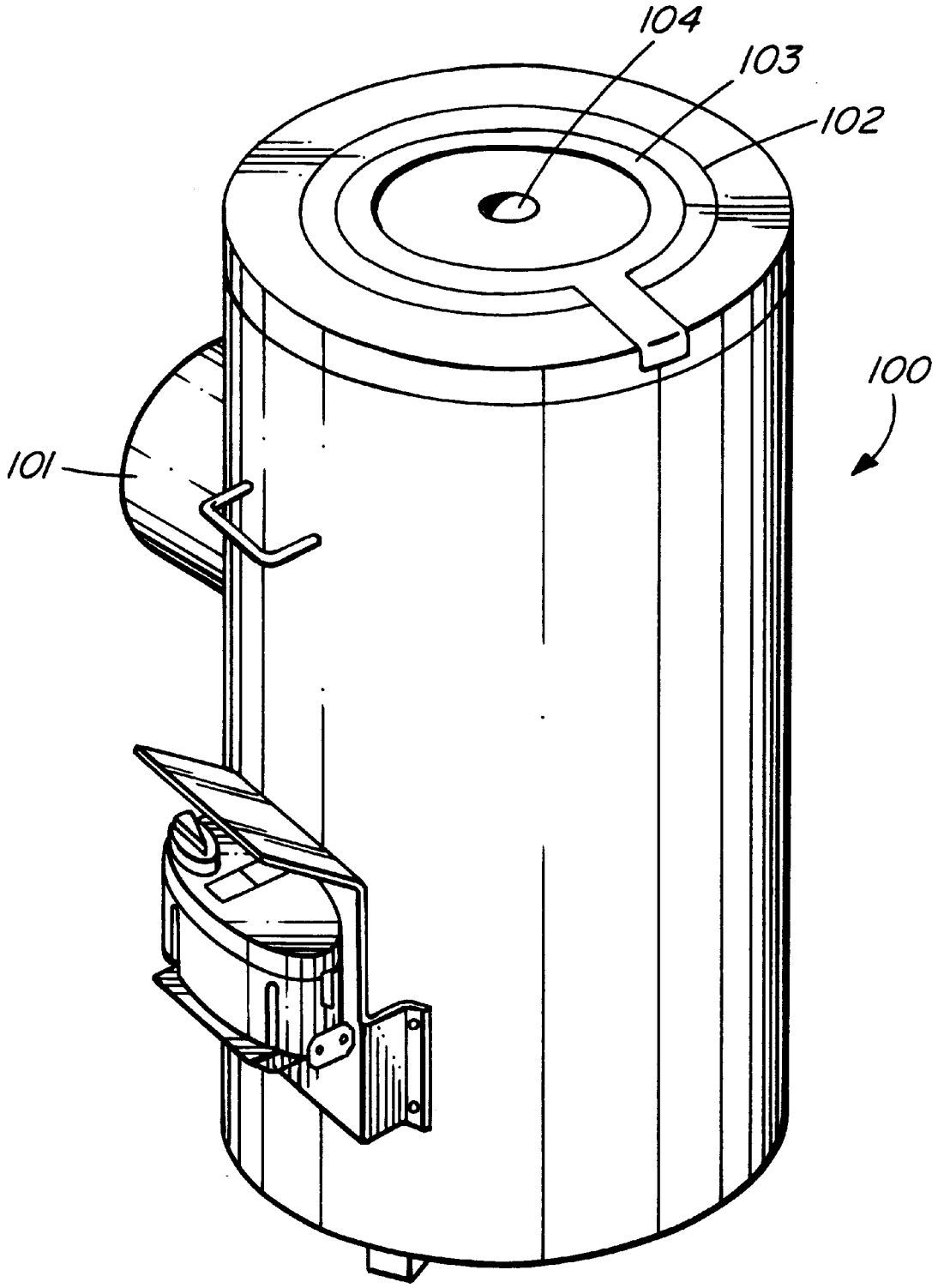
FIG. 5 is a diagrammatic isometric view of a barracks heater according to a further aspect of the invention.
Figure 6:
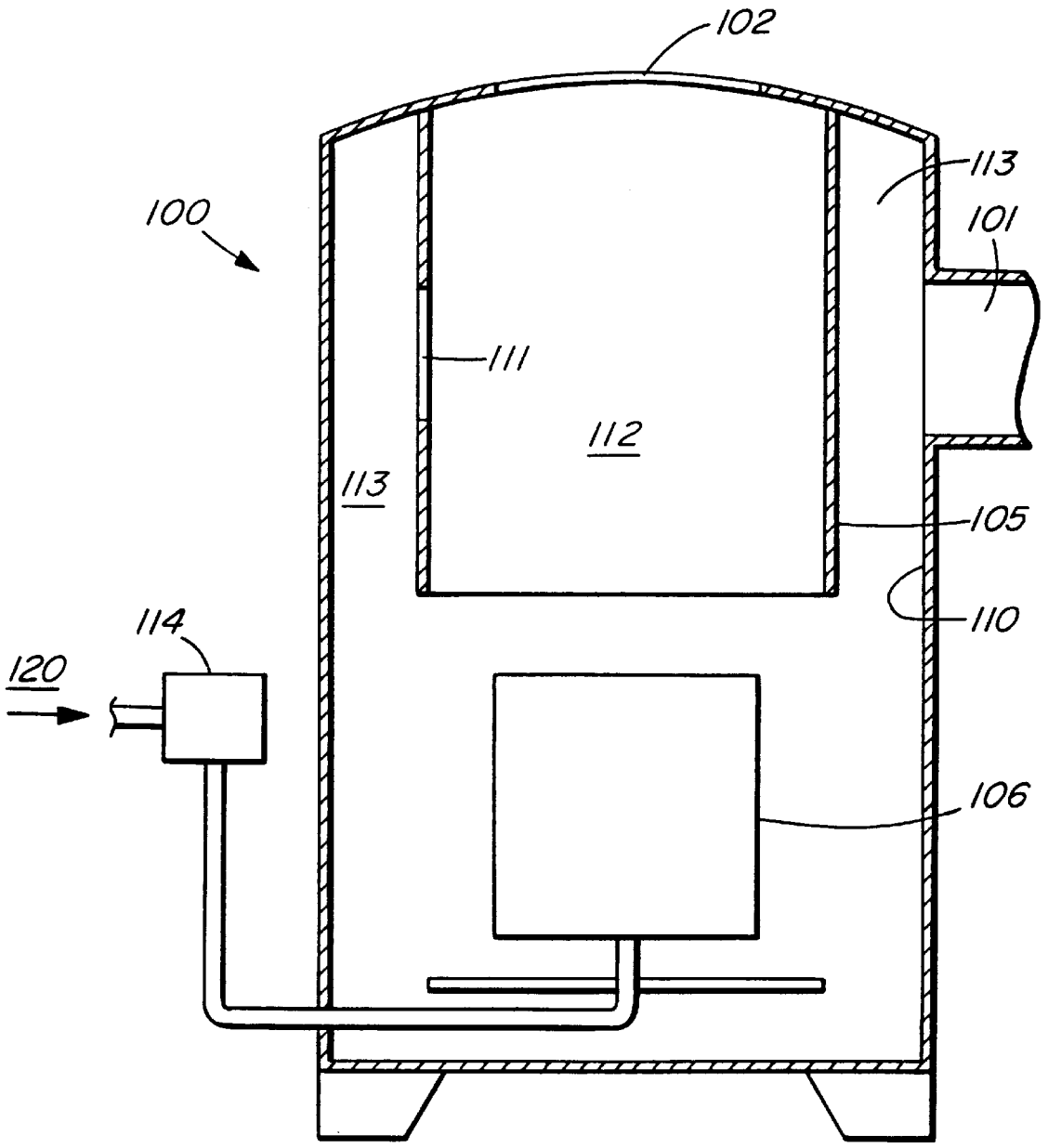
FIG. 6 is a cross-sectional view of the barracks heater of FIG. 5 with the burner according to the invention illustrated in phantom.

Yet a further embodiment of the invention is illustrated in FIG. 5. A barracks heater generally illustrated at 100 is utilised for heating army barracks, for example, or other enclosed areas which require a stack or vent 101 which communicates with the outside atmosphere. The heater 100 has a burner 106 (FIG. 6) which may be either the burner 12 illustrated in FIG. 3 or the burner 61 illustrated in FIGS. 4A–4C.

Heater 100 has an opening 102 in the top of the heater 100 which is closed by a removable lid 103 having a viewing port 104. The lid 103 is removed in order to allow access to the burner 106 in order to commence the operation of the heater 100.

Heater 100 has an inner liner 105. The inner liner 105 extends circumferentially around the inner surface 110 and is spaced therefrom. An annular opening 111 in the inner liner 105 communicates with the combustion chamber 112 and the annulus 113 between the inner surface 110 and the inner liner 105, in turn, communicates with the stack or flue 101.

Heater 100 further has a zero-pressure regulator 114 connected between the fuel supply generally illustrated at 120 and the burner 106 which is used to regulate the flow of fuel to the burner 106.

Figure 7:
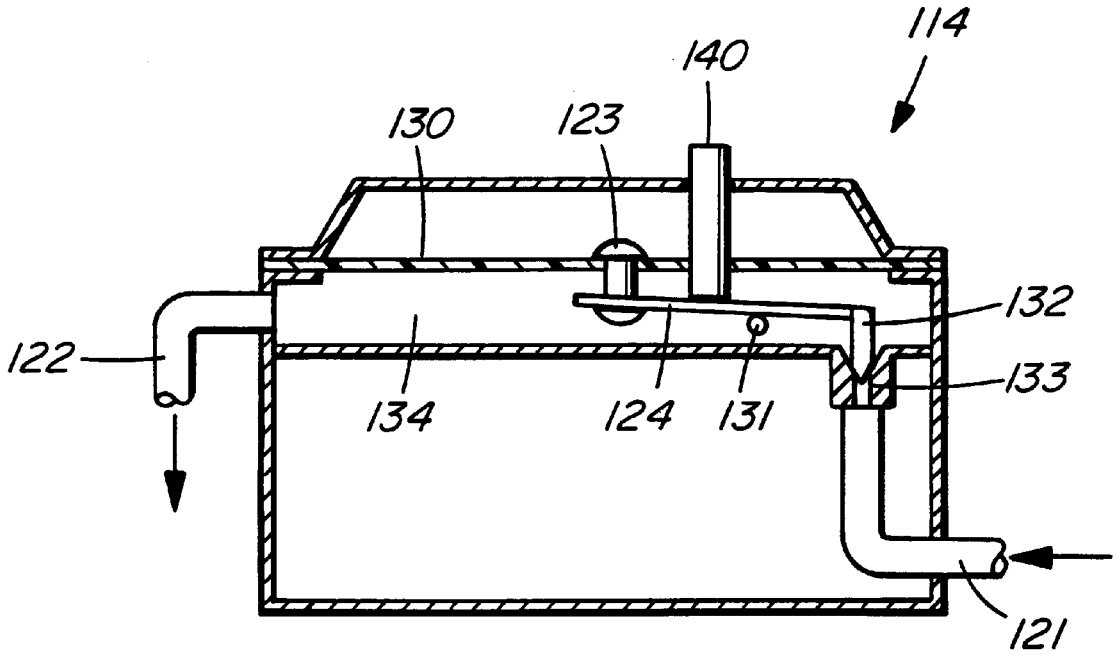
FIG. 7 is a diagrammatic view of a zero pressure regulator used with the barracks heater of FIG. 5 and further illustrating a fuel supply for the burner and heater.

The zero-pressure regulator 114 is illustrated in more detail in FIG. 7. It comprises a fuel inlet 121 and a fuel outlet 122. A rivet 123 connects a lever arm 124 to a diaphragm 130. Lever 124 rotates about a fulcrum 131 and has a needle 132 attached to the end opposite from the end which is riveted to the diaphragm 130. The needle 132 moves in and out of contact with a complementary seat 133 thereby to allow fuel to enter chamber 134 to equalize any pressure differential between the fuel outlet 122 and the fuel inlet 121 and flow to the burner 106 as the burner 106 uses the fuel under operating conditions. A button 140 allows the needle 132 to be manually moved off the seat 133 so that the burner 106 may be primed with the fuel prior to the commencement of operation of the burner 106.

In operation, the user will prime the burner 106 by pressing button 140 which will allow fuel flow to the burner 106. Lid 103 (FIG. 5) is then opened and fuel is introduced into the combustion chamber 112. A flame is manually introduced into the combustion chamber 112 in order to initiate combustion of the fuel and combustion ensues.

As the combustion commences, fuel will be used by the burner 106 and the combustion will occur in the combustion chamber 112. The combustion products will pass through annular opening 111 into the annulus 113. The use of the inner liner 105 allows for a greater residence time of the combustion products within the heater 100 with the result that the inner liner 105 and the surface 110 become heated to a higher temperature prior to the combustion gases passing from the heater 100 via stack 101.

As the fuel is vaporized within burner 106, a vacuum will be created within chamber 134 which will tend to pull down the flexible diaphragm 130 (FIG. 7). Lever arm 124, being attached to diaphragm 130 by rivet 23, rotates counterclockwise about fulcrum 131 and needle 132 leaves seat 133 thereby allowing fuel to flow into chamber 134 until the pressure within the chamber 134 is equalized. Thereafter, the needle 132 again seats within seat 133 and terminates fuel flow. Thus, the motion of needle 132 in seat 133 is a continuous one depending upon the fuel utilised in burner 101.

Figure 8:
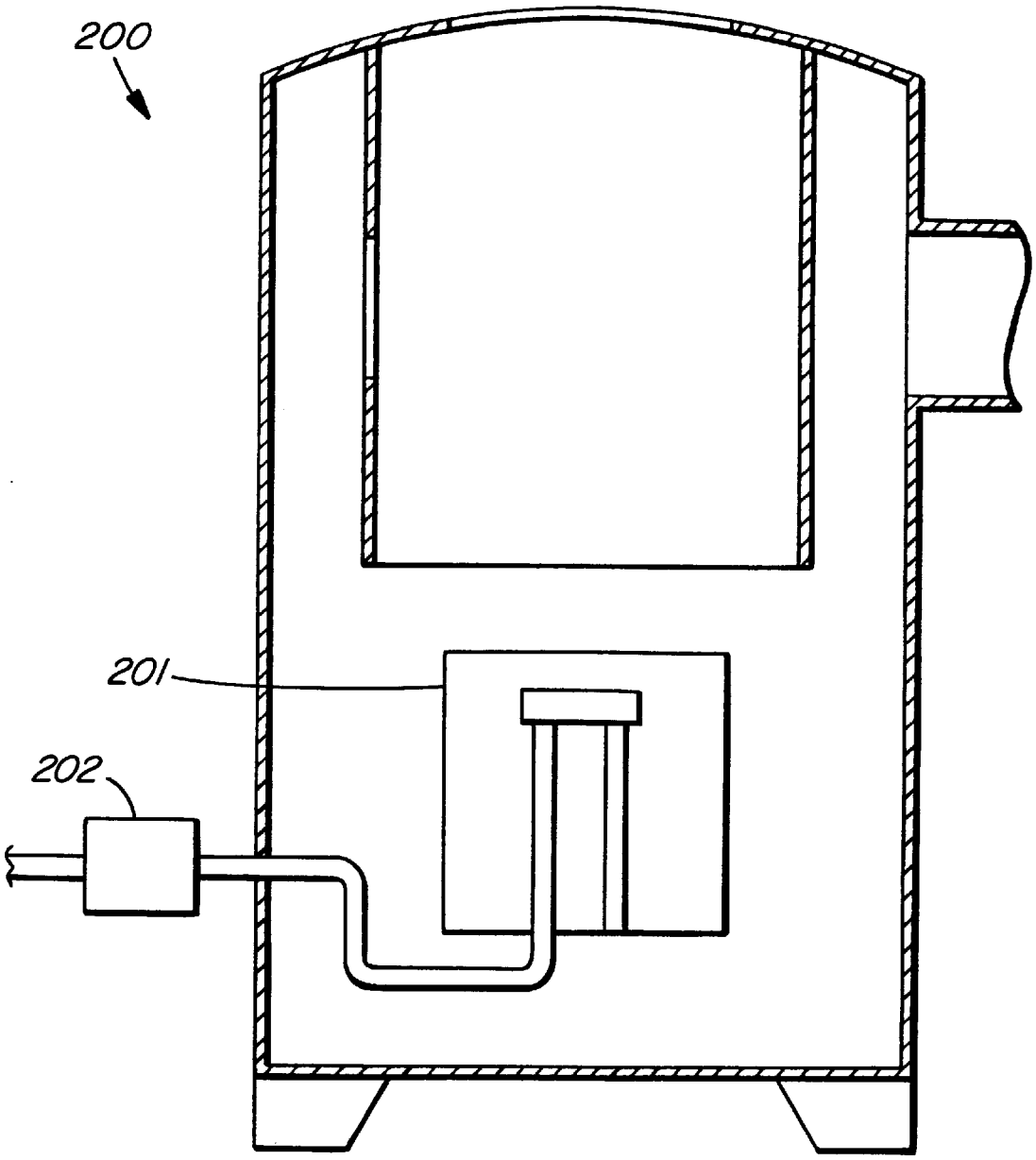
FIG. 8 is a diagrammatic cross-sectional view illustrating the zero pressure regulator and the barracks heater of FIG. 5 used with the fuel vaporizer of FIG. 3 according to the invention.
Figure 9:
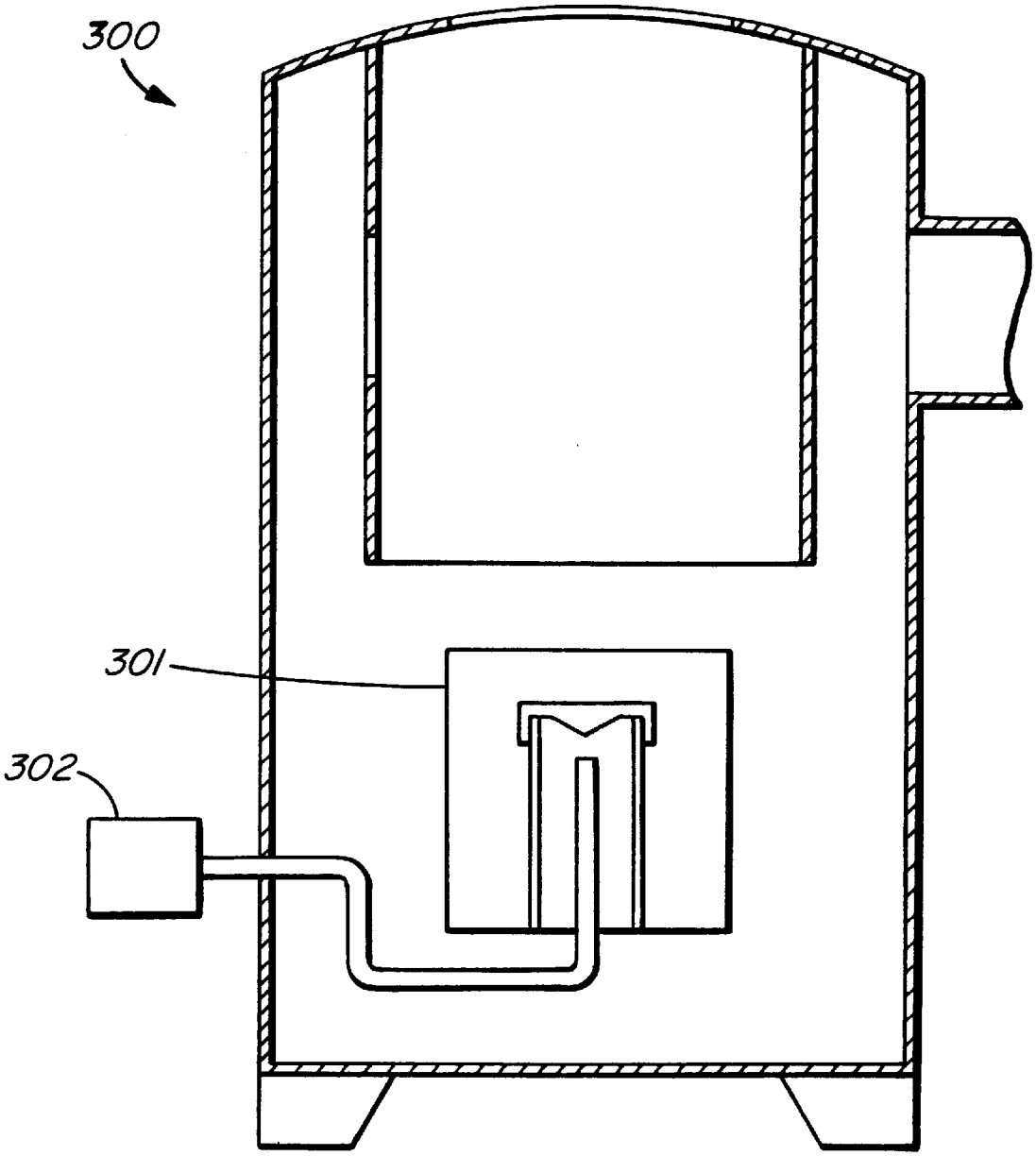
FIG. 9 is a diagrammatic view illustrating the zero pressure regulator and the barracks heater of FIG. 5 used with the fuel vaporizer of FIGS. 4A–4C.

The burner 106 of the barracks heater 100 may be either that burner 52 as illustrated in FIGS. 8 and 3 or the burner 61 as illustrated in FIGS. 9 and 4A.

With reference to FIG. 8, the barracks heater 200 is illustrated as having a burner 201 which is identical to the burner 12. This burner 201 is commonly referred to as an "R-tube" burner since its configuration somewhat resembles the letter R. A zero-pressure regulator 202 is conveniently used with the barracks heater 200 and burner 201.

With reference to FIG. 9, the barracks heater 300 is illustrated as having a burner 301 which is identical to the burner 61 illustrated in FIGS. 4A–4C. This burner 301 is commonly referred to as an "S-tube" burner. A zero pressure regulator 303 may also be used with the barracks heater 300 and burner 302.

While a specific embodiment of the invention has been described, such description is illustrative of the invention only and should not be taken as limiting its scope as defined in accordance with the accompanying claims.

What is claimed is:

1. A heater comprising an outer casing and a burner positioned within said outer casing, said burner including a fuel vaporizer, said vaporizer having a non-porous longitudinal member for carrying and vaporizing fuel extending substantially vertically and being centrally located within said burner, said longitudinal member having a first upper end and an outside, said first upper end being open, a cap centrally located over said first upper end of said longitudinal member, a casing having a longitudinal axis and an inside, said casing extending downwardly from said cap and surrounding said longitudinal member over a substantial portion of the length of said longitudinal member, a fuel regulator automatically operable during operation of said burner to provide fuel to said longitudinal member and to maintain the surface of said fuel within said longitudinal member below said first upper end of said longitudinal member, and an annulus defined by said outside of said longitudinal member and said inside of said casing, members within said annulus extending from said outside of said longitudinal member to said inside of said casing, said members extending longitudinally between and contacting both said longitudinal member and said casing over a substantial distance of said longitudinal member, said annulus communicating with said most vertical end of said longitudinal member and being operable to carry fuel vapour received from said longitudinal member downwardly and to disperse said fuel vapour around said annulus of said longitudinal member.

2. A heater according to claim 1 wherein said regulator provides a predetermined quantity of fuel to said fuel vaporizer.

3. A heater according to claim 2 wherein said fuel regulator is a zero pressure regulator.

4. A heater according to claim 2 and further comprising an inner casing, said inner casing having an outside surface and forming an annulus between said outer casing and said outside surface of said inner casing, said inner casing further having an opening communicating with said annulus.

5. An unpressurized burner comprising a fuel vaporizer, said vaporizer having a non-porous longitudinal member for carrying and vaporizing fuel extending substantially vertically and being centrally located within said burner, said longitudinal member having an open uppermost end and an outside, a cap centrally located over said open uppermost end of said longitudinal member, a casing having a longitudinal axis and an inside, said casing extending downwardly from said cap and surrounding said longitudinal member over a substantial portion of the length of said longitudinal member and an annulus defined by said outside of said longitudinal member and said inside of said tubular casing, members within said annulus extending from said outside of said longitudinal member to said inside of said casing, said members extending longitudinally between and contacting both said longitudinal member and said casing over a substantial distance of said longitudinal member, said annulus communicating with said open uppermost end of said longitudinal member, said annulus being operable to carry fuel vapor received from said longitudinal member downwardly and to disperse said fuel vapor around the circumference of said longitudinal member.

6. A burner as in claim 5 and further comprising a fuel regulator to provide a predetermined quantity of fuel to said fuel vaporizer, said fuel regulator being a zero pressure regulator.

* * * * *